US008332971B2

(12) United States Patent
Bennett et al.

(10) Patent No.: US 8,332,971 B2
(45) Date of Patent: Dec. 18, 2012

(54) APPARATUS FOR SUPPORTING A PERSON HAVING ENHANCED PORTABILITY AND METHOD OF USING SAME

(76) Inventors: Roderick Bennett, Windsor Locks, CT (US); Christopher W. Callahan, Cambridge, NY (US)

( * ) Notice: Subject to any disclaimer, the term of this patent is extended or adjusted under 35 U.S.C. 154(b) by 972 days.

(21) Appl. No.: 12/190,091

(22) Filed: Aug. 12, 2008

(65) Prior Publication Data

US 2010/0038934 A1 Feb. 18, 2010

(51) Int. Cl.
*A47K 3/022* (2006.01)

(52) U.S. Cl. ..... 4/560.1; 4/578.1; 4/579; 4/562.1

(58) Field of Classification Search ..... 4/560.1, 4/578.1, 579, 571.1, 562.1; 297/35, 36, 37, 297/411.3, 411.32, 411.34
See application file for complete search history.

(56) References Cited

U.S. PATENT DOCUMENTS

| | | | | |
|---|---|---|---|---|
| 797,451 | A | 8/1906 | McBryde | |
| 2,237,076 | A * | 4/1941 | Kenney et al. | 4/579 |
| 3,381,317 | A | 5/1968 | Daniels et al. | |
| 3,449,773 | A | 6/1969 | Seib | |
| 3,718,365 | A | 2/1971 | Gibson | |
| 4,150,445 | A | 4/1979 | Bailey | |
| 4,253,203 | A | 3/1981 | Thomas | |
| 5,390,378 | A * | 2/1995 | Janisch | 4/578.1 |
| 5,784,728 | A * | 7/1998 | Weddendorf et al. | 4/579 |
| 5,887,297 | A | 3/1999 | Sutor | |
| 6,226,810 | B1 * | 5/2001 | Weddendorf et al. | 4/579 |
| 6,615,420 | B1 | 9/2003 | Hyden et al. | |

* cited by examiner

*Primary Examiner* — William Gilbert
*Assistant Examiner* — Patrick Maestri
(74) *Attorney, Agent, or Firm* — GFD Patents LLC; Gerald F. Dudding

(57) ABSTRACT

An apparatus and method for supporting a person in a bathtub or shower. The apparatus comprising: an elongated base, comprising a tapered yoke operably coupled to a first end of the elongated base and a stabilizer operably coupled to a second end of the elongated base. The apparatus comprising a rotatable and/or slidable chair, wherein the rotatable and/or slidable chair is operably coupled to the same end of the elongated base as the tapered yolk. The method comprising: providing an apparatus having a rotatable and/or slidable chair, wherein some of the components may be foldable, such as a foldable seat, a foldable back, foldable legs, and a plurality of arms. Folding the foldable components of the slidable and/or rotatable chair make transporting easier and safer because the apparatus is more compact when the foldable components are in the folded position.

25 Claims, 11 Drawing Sheets

APPARATUS FOR SUPPORTING A PERSON HAVING ENHANCED PORTABILITY AND METHOD OF USING SAME

FIELD OF THE INVENTION

The present invention relates generally to an apparatus for supporting a person and methods of use. More specifically, the present invention relates to light weight portable seats or benches and methods of use for personal hygiene activities.

BACKGROUND

Current global demographic trends indicate a growing segment of the population is aging yet remaining active in travel. The combination of this aging population and their need for a more transportable shower seat suggests a new set of design criteria for such art.

SUMMARY OF THE INVENTION

A first aspect of the present invention provides an apparatus for supporting a person, comprising: an elongated base, comprising a tapered yoke operably coupled to a first end of the elongated base and a stabilizer operably coupled to a second end of the elongated base; and a rotatable and/or slidable chair, wherein the rotatable and/or slidable chair is operably coupled to the same end of the elongated base as the tapered yolk.

A second aspect of the present invention provides an apparatus for supporting a person, comprising: a rotatable and/or slidable chair: comprising a seat; a back; and a plurality of arms; either of an elongated base and a slidable pivot connector therein; or a frame and a slidable pivot connector supported by the frame, wherein the elongated base and the slidable pivot connector, therein, or the slidable pivot connector supported by the frame are operably coupled to the rotatable and/or slidable chair.

A third aspect of the present invention provides an apparatus, comprising: an elongated base having a tapered yoke operably coupled to a first end of the elongated base;
a rotatable and/or slidable chair, comprising: a seat; a back; and a plurality of arms 20, wherein the arms are operably coupled to only the seat and do not come in contact with the back of the rotatable and/or slidable chair so that an outermost surface of the arms of the rotatable and/or slidable chair form a coplanar surface with a first surface of the seat by folding into recesses in the seat, and wherein the rotatable and/or slidable chair is operably coupled to the same end of the elongated base as the tapered yolk by a slidable pivot connector for rotating the rotatable and/or slidable chair from about 0° to about 360°.

A fourth aspect of the present invention provides a method for supporting a person in a bath tub or a shower stall, comprising: providing an apparatus, comprising an elongated base having a slidable pivot connector, therein; providing a rotatable and/or slidable chair comprising: a seat; a back; and a plurality of arms, wherein the arms are operably coupled to only the seat, wherein the arms do not come in contact with the back of the rotatable and/or slidable chair and wherein an outermost surface of the arms of the rotatable and/or slidable chair form a coplanar surface with a first surface of the seat by being folded into recesses in the seat; installing the apparatus on opposite vertical walls of a bathtub or shower; and unfolding the arms of the rotatable and/or slidable chair.

DESCRIPTION OF THE INVENTION

FIGS. 1-9 depict an apparatus 10, 300, 500, for supporting a person having several features that enhance the value, usefulness, reliability, portability and durability. The devices are generally, though not exclusively, used by the elderly with limited mobility.

Figure 1:
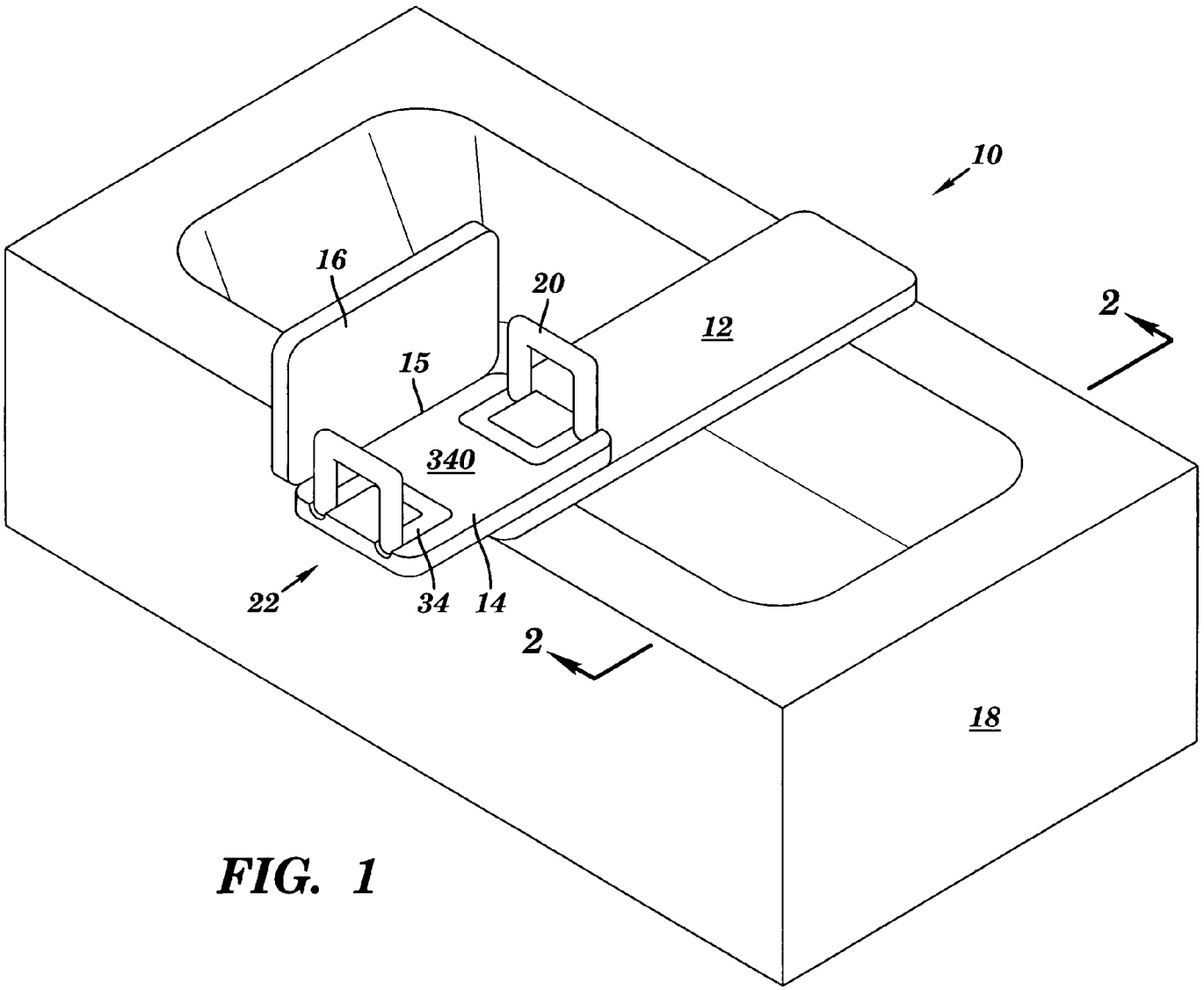
FIG. 1 depicts an isometric view of an apparatus having enhanced portability, according to the present invention.

FIG. 1 depicts an isometric view of the apparatus 10 having enhanced portability which enables a user to more easily, safely and comfortably support himself (with or without assistance) in a shower or bath tub 18. The apparatus 10 comprises: a rotatable and/or slidable chair 22 and the bathtub or shower 18. The rotatable and/or slidable chair 22 depicted in FIGS. 1-2, and described in associated text, herein, comprises a back support 16, a seat 14, foldable arms 20, a foldable and/or rotatable yolk 24, a non-slip stabilizer 36, and an elongated base 12, the elongated base 12 being between the seat 14 and the bathtub or shower 18. The foldable arms 20 may fold into recesses 34 in the surface 340 of the seat 14.

Figure 2:
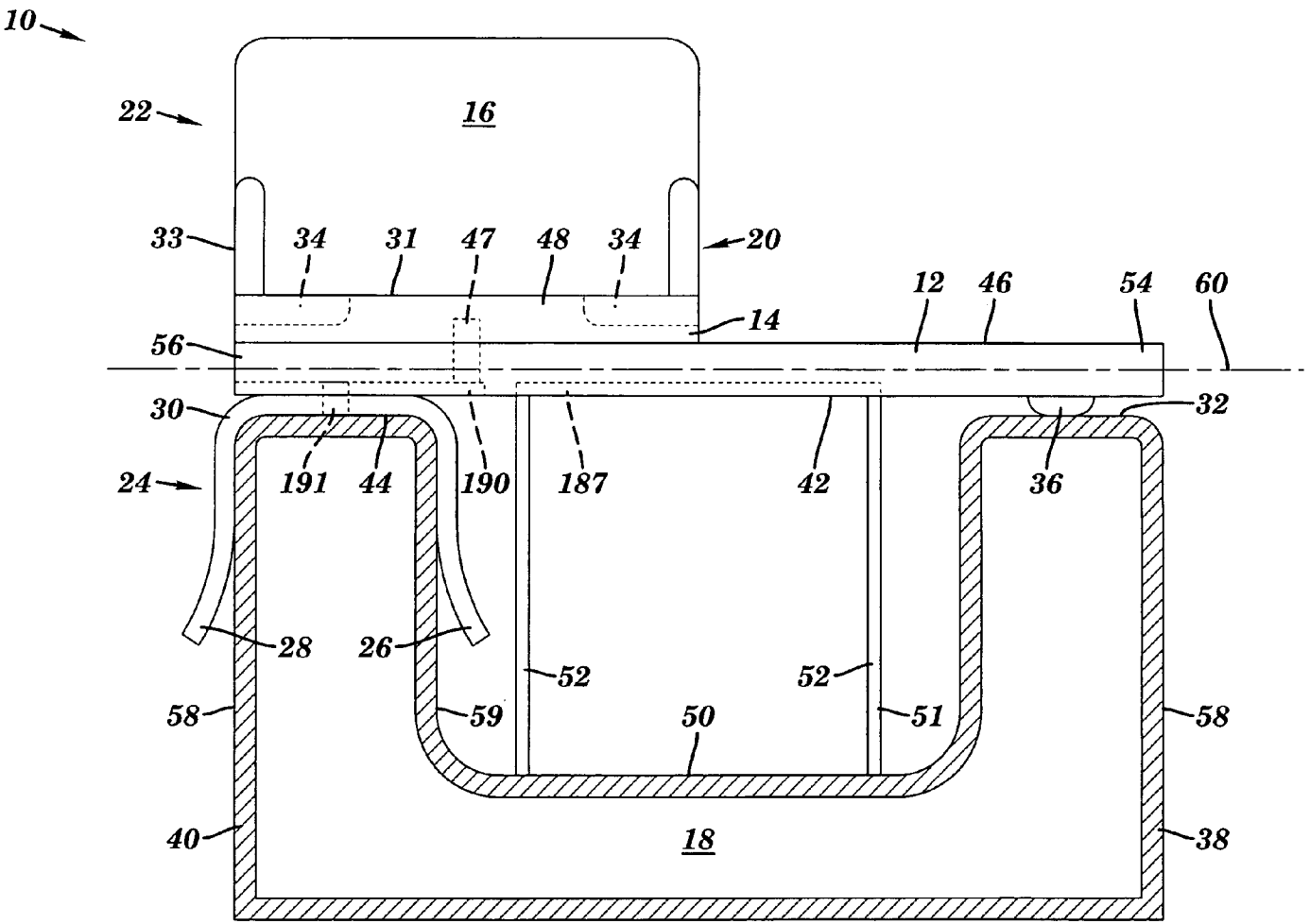
FIG. 2 depicts a horizontal cross-sectional view taken along line 2-2 of FIG. 1, according to embodiments of the present invention.

FIG. 2 depicts a horizontal cross-sectional view of the apparatus 10 having enhanced portability taken along line 2-2 of FIG. 1. In one embodiment, the rotatable and/or slidable chair 22 may be adapted to slide along the longitudinal axis 60 of the elongated base 12 or rotate on a slidable pivot 47 about an axis that is orthogonal to a surface 46 that may be parallel to the longitudinal axis 60 of the elongated base 12. The slidable pivot 47 may be a ball and socket type, or a swivel and pin or axle type. Hereinafter, "operably coupled or "operably coupling" is defined as linking or mechanically and physically attaching a first supporting structure, such as the rotatable and/or slidable chair 22 to a second supporting structure, such as the elongated base 12, so that the first supporting structure may freely rotate about an axis of the second supporting structure and/or slide along a longitudinal axis of the second supporting structure.

In another embodiment, the rotatable and/or slidable chair 22 may be mechanically and physically attached to the elongated base 12.

The rotatable and/or slidable chair 22 may, in one embodiment, have a foldable back support 16 and foldable arms 20 operably coupled to the rotatable and/or slidable chair 22 for back support and arm support, respectively, of the user.

In one embodiment, the rotatable and/or slidable chair 22 of the apparatus 10 may be made of hollow molded plastic, such as, for example, flexible plastic, curable silicone elastomer, organic elastomer, such as polyester or polyurethane, viton, sanoprene, or Ethylene-Propylene-Diene Monomer (EPDM). Alternatively, the rotatable and/or slidable chair 22 of the apparatus 10 may be made of wood, or light metals such as, for example, aluminum.

The elongated base 12 has a first end 56 and a second end 54. A foldable and/or rotatable yolk 24 may be operably coupled to the first end 56 and a stabilizer 36 the second end 54 may be operably coupled to the second end 54. Hereinafter, "operably coupled" or "operably coupling" means linking or mechanically and physically attaching the foldable and/or rotatable yolk 24 or the rotatable and/or slidable chair 22 to the elongated base 12, wherein the axis of rotation of the foldable and/or rotatable yolk 24 and rotatable and/or slidable chair 22 is orthogonal to a longitudinal axis 60 of the elongated base 12.

The foldable and/or rotatable yolk 24 and the non-slip stabilizer 36 may be made from any appropriate solid material characterized by non-slip properties, such as vulcanized rubber, or flexible plastic, curable silicone elastomer, organic elastomer, such as polyester or polyurethane, viton, sanoprene, or Ethylene-Propylene-Diene Monomer (EPDM).

In one embodiment, the foldable and/or rotatable yolk 24 may have gripping arms 26, 28 for physically and mechanically gripping an outer surface 58 and the inner surface 59 of a wall 40 of the shower or bath tub 18, respectively.

In one embodiment, the non-slip stabilizer 36 may lie on a surface 32 of a wall 38 of the shower or bath tub 18, thereby supporting the base 12 and the rotatable and/or slidable chair 22 thereon.

In one embodiment, the apparatus 10 comprises a shower or bath tub 18. The stabilizer 36 on the second end 54 of the elongated base 12 may be a non-slip stabilizer 36 operably coupled to a surface 42 of the second end 54 of the elongated base 12, so that slippage of the elongated base 12 and the whole apparatus 10 in a direction orthogonal to the longitudinal axis of the elongated base is substantially prevented when the non-slip stabilizer 36 lies on a supporting surface 32 of the wall 38 of the shower or bath tub 18, thereby essentially completely stabilizing the second end 54 of the elongated base 12 and the rotatable and/or slidable chair 22, thereon.

In one embodiment, the foldable and/or rotatable yolk 24, in a tub-supported model, enables a secure fixing of the rotatable and/or slidable chair 22 in a specific location along the surfaces 32, 44, 58, 59, of the tub wall 40, without marring the tub surfaces 32, 44, 58, 59.

In one embodiment, the foldable and/or rotatable yolk 24 may pivot between about 0 and about 360° on a pivot device 191, wherein an axis of rotation of the pivot device 191 is orthogonal to a surface 42 of the elongated base 12 that is parallel to the longitudinal axis 60, so that the foldable and/or rotatable yolk 24 may fold into recess 190 of the elongated base 12 so that an overall height of the rotatable and/or slidable chair 22 is reduced between about 20% and about 50% when the foldable and/or rotatable yolk 24 of the rotatable and/or slidable chair 22 is folded into the recess 190 of the elongated base 12.

Alternatively, the foldable and/or rotatable yolk 24 may be replaced by a second non-slip stabilizer similar to the non-slip stabilizer 36, resulting in non-slip stabilizers 36 on both ends 54 and 56 of the elongated base 112. The non-slip stabilizers 36 on both ends 54 and 56 operably coupled to a surface 42 of the first and second ends 54 and 56 of the elongated base 12, so that slippage of the elongated base 12 and the whole apparatus 10 in a direction orthogonal to the longitudinal axis of the elongated base is substantially prevented when the non-slip stabilizers 36 lie on a supporting surfaces 32, 44 of the walls 38 and 40 of the shower or bath tub 18, thereby essentially completely stabilizing the first and second ends 54 and 56 of the elongated base 12 and the rotatable and/or slidable chair 22, thereon.

Alternatively, the elongated base 12, depicted in FIG. 2 and described in associated text, herein, may be supported by legs 52 that may be directly supported by and lie on the bottom surface 50 of the shower or bath tub 18. In one embodiment, the apparatus 10, comprises a slidable and/or rotatable chair 22 having a seat 14 operably coupled to the elongated base 114. Legs 52 of the elongated base 114 may fold into recesses 187 in the elongated base 114, so that a surface 51 of the legs 52 may become flush or coplanar with the surface 42 of the elongated base 12. The rotatable and/or slidable chair 22 may have a smaller three dimensional volume, based on the length, depth and height of the rotatable and/or slidable chair 22 when the legs 52 and the rotatable and/or foldable yolk 24 may be folded into the recesses 42 and 190, respectively. In one embodiment, the three dimensional volume of the rotatable and/or slidable chair 22 is 1,080 cubic inches when elongated base 114 is 36 in. long×20 in. high×15 in. deep, when the legs 52 are extended under the elongated base 114 to support it. The three dimensional volume of the rotatable and/or slidable chair 22 is 720 cubic inches when elongated base 114 is 36 in. long×20 in. high×1 in. deep, when the legs 52 are collapsed under the elongated base 114 for easier and more comfortable and safe transporting or carrying the rotatable and/or slidable chair 22. The three dimensional volume of the rotatable and/or slidable chair 22 may be reduced by 720 cubic inches/1,020 cubic inches, or about 31%.

Figure 3A:
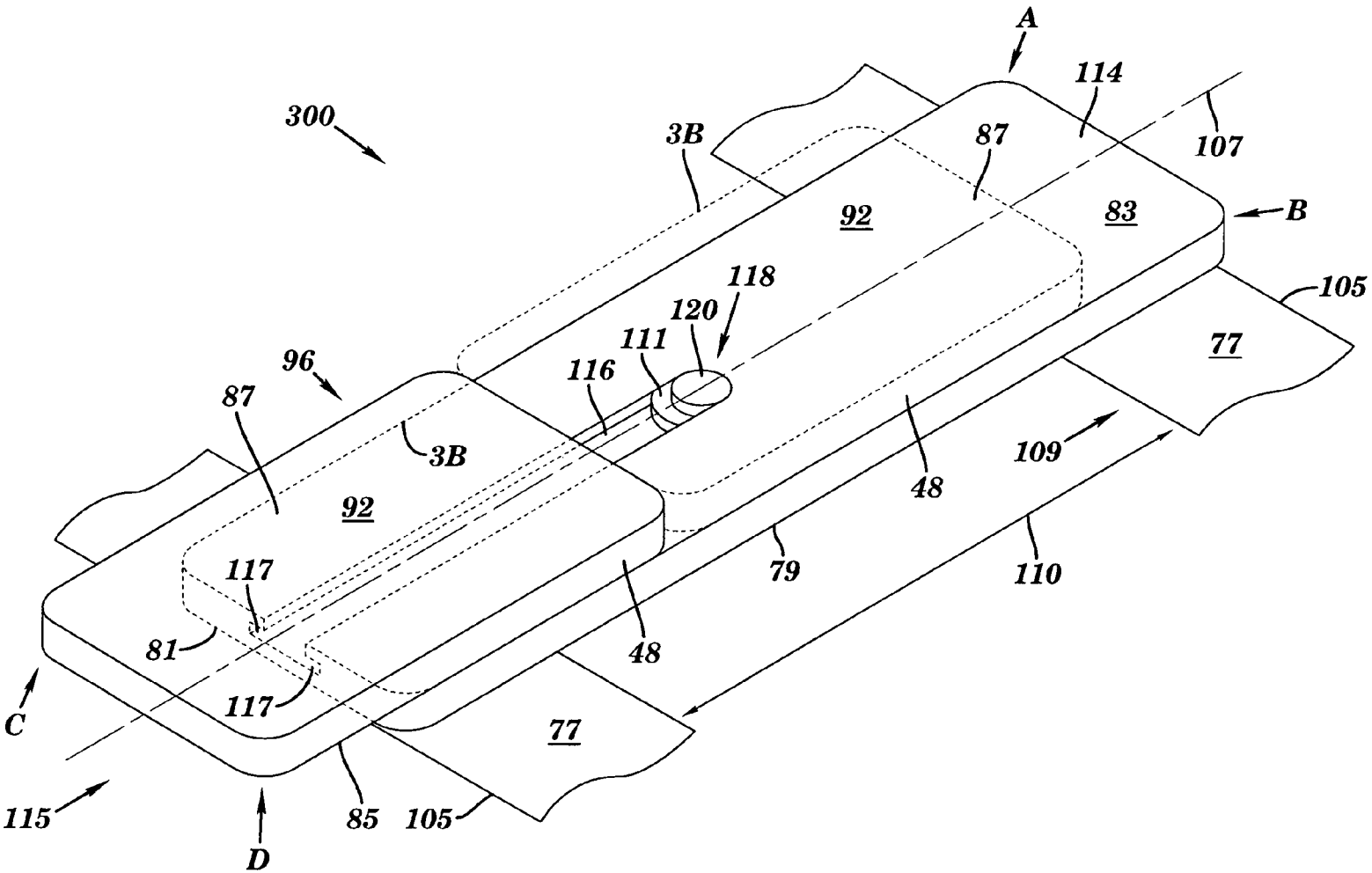
FIG. 3A depicts an elevation view of an apparatus having enhanced portability, according to embodiments of the present invention.

FIG. 3A depicts an elevation view of an apparatus 10, 300, having enhanced portability, which enables a user to more easily, safely and comfortably support himself (with or without assistance) in a shower or bath tub 109. The apparatus 10, 300, comprises: a rotatable and/or slidable chair 115; and a bathtub or shower 109. The rotatable and/or slidable chair 115 comprises an elongated base 114; and a foldable chair 96.

The elongated base 114 has an upper surface 83 and a parallel oppositely disposed lower surface 79. The bottom surface 85 of the seat 87 of the rotatable and/or slidable chair 115 and the upper surface 83 of the elongated base 114 form an interface 81 that lies in a longitudinal plane defined by the points A, B, C, and D that lie in the surface 83 of the elongated base 114. Therefore, the upper surface 83 of the elongated base 114 supports the seat 87 because the lower surface 85 of the seat 87 lies on the upper surface 83 of the elongated base 114. The rotatable and/or slidable chair 115 may be supported by the walls 105 of the bathtub or shower 109 because the lower surface 79 of the elongated base 114 lies on the surface 77 of the walls 105 of the bathtub or shower 109.

A grooved channel 116, having grooves 117 has been cut into a bottom surface 85 of the seat 87 of the rotatable and/or slidable chair 115. A slidable pivot connector 118 running along the longitudinal axis 107 of the grooved channel 116, may operably couple the elongated base 114 and the seat 87 of the foldable chair 96. The slidable pivot connector 118 may be a pin or axle 120 having a concentric collar 111. Hereinafter, "operably coupling" or "operably coupled" is defined as linking or mechanically and physically attaching a first supporting structure, such as the rotatable and/or slidable chair 115 to a second supporting structure, such as the elongated base 114, so that the first supporting structure may freely rotate in a direction of the arrow 89 about a vertical axis running perpendicularly to a longitudinal plane of the second supporting structure and/or slide in a direction of the bidirectional arrow 110 along the longitudinal plane of the second supporting structure.

Figure 6:
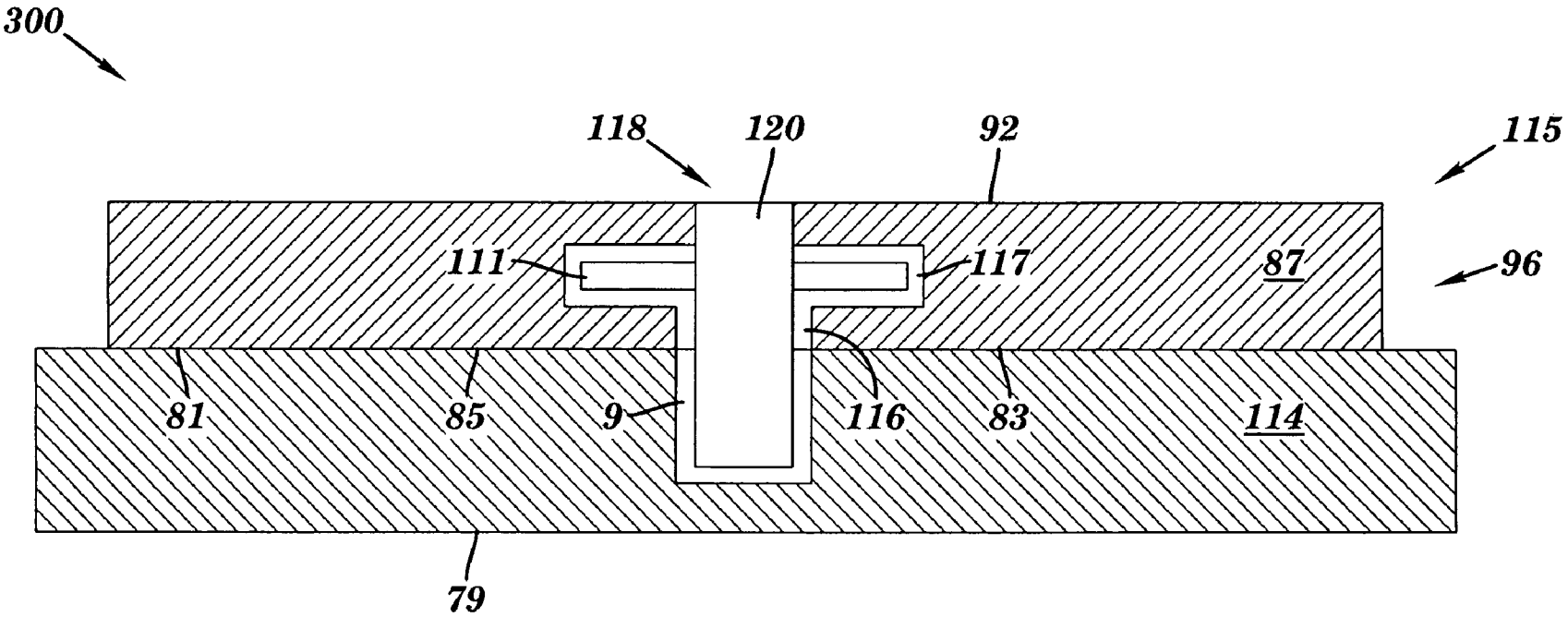
FIG. 6 depicts a horizontal cross-sectional view taken along line 6-6 of FIG. 5, according to embodiments of the present invention.

The slidable pivot connector 118 comprises a pin or axle 120 having a concentric collar 111, the pin or axle 120 having a longitudinal axis that is orthogonal to the longitudinal axis 107 of the rotatable and/or slidable chair 115. Referring to FIG. 6, the pin or axle 120 extends from a well 9 within the elongated base 114 into the grooved channel 116 that lies within the seat 87 of the rotatable and/or slidable chair 115 and runs along the longitudinal axis 107. The slidable pivot connector 118 may be a pin or axle 120 having a concentric collar 111. When the slidable pivot connector 118 is a pin or axle 120 having the concentric collar 111, the pin or axle 120 runs along the slot 116 and the concentric collar 111 runs along the grooves 117 both of which run along the longitudinal axis 107, operably coupling the rotatable and/or slidable chair 115 to the elongated base 114. Hereinafter, "operably coupling" or "operably coupled" is defined as linking or mechanically and physically attaching a first supporting structure, such as the rotatable and/or slidable chair 115 to a second supporting structure, such as the elongated base 114, so that the first supporting structure may freely rotate in a direction of the arrow 89 about a vertical axis running perpendicularly to a longitudinal plane of the second supporting structure and/or slide in a direction of the bidirectional arrow 110 along the longitudinal plane of the second supporting structure. The slidable pivot connector 118 may be a type of connector used in a lazy susan for operably coupling a rotatable tray and a supporting structure. Hereinafter, a "lazy susan" is defined as a rotatable tray used for serving food, condiments, or relishes. The tray may rotate on a pin or axle 120. The slidable pivot connector 118 may be a ball and socket connector, in which one end of the ball and socket may be inserted into the surface 83 of the elongated base 114, and another end of the ball and socket may be attached to the seat 87 of the foldable chair 96. Alternatively, the slidable pivot connector 118 may be a swivel and pin or axle connector, having a pin or axle 120 inserted into the surface 83 of the elongated base 114, or into the surface 85 of the seat 87, so that the ball and socket connector or the swivel and pin or axle connector operably couples the first and second supporting structures, such as the rotatable and/or slidable chair 115 and the elongated base 114.

Figure 3B:
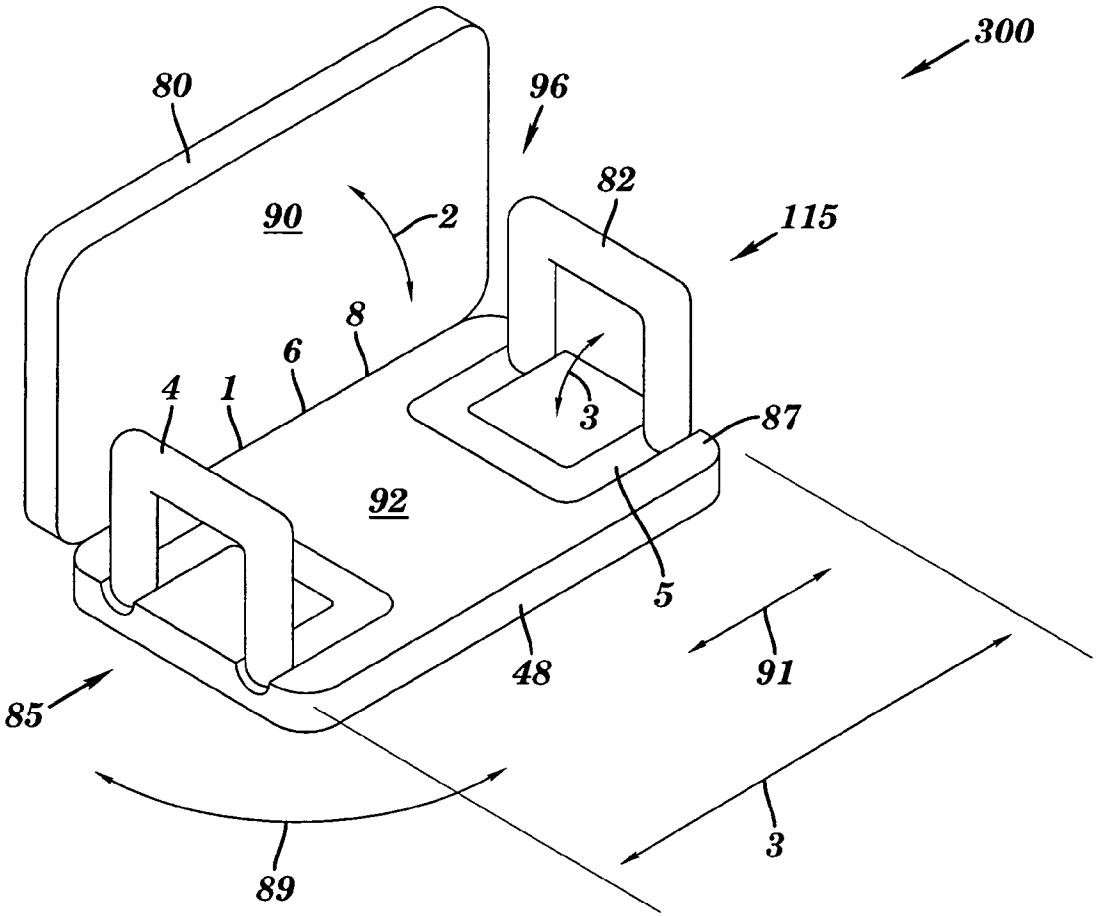
FIG. 3B depicts an exploded view of the foldable chair of the rotatable and/or slidable chair.

FIG. 3B depicts an exploded view of the foldable chair 96 of the rotatable and/or slidable chair 115. In one embodiment, the rotatable and/or slidable chair 115 of the apparatus 10, 300 enables a user to more easily, safely and comfortably gain access to the rotatable and/or slidable chair 115 to support himself (with or without assistance) in a shower or bath tub 109 by sliding along the grooved channel 116 in the direction of the bidirectional arrow 91 along the longitudinal plane defined by the points A, B, C, and D on the surface 83 of the elongated base 114.

The foldable chair 96 comprises: a foldable back support 80, a seat 87 and foldable arms 82. The foldable back support 80 may be operably coupled, using operable coupling 6, to the seat 87, so that the foldable back support 80 may fold along axis 1 in the direction of the bidirectional arrow 2. The operable coupling 6 may be at least one hinge or any appropriate flexible joint that may operably couple the foldable back support 80 to the seat 87. Folding along axis 1 may provide a more compact foldable chair 96 because the volume of the foldable chair 96 is reduced when the foldable back support 80 folds in the direction of the bidirectional arrow 2 along axis 1. This may enable more easy transportation of the rotatable and/or slidable chair 115.

The seat 87 has an upper surface 92 and a parallel oppositely disposed bottom surface 85. The foldable arms 82 may fold in the direction of the bidirectional arrow 3 into recesses 5 in the surface 92 of the seat 87 so that an upper surface 4 of the foldable arms may become flush or coextensive with a plane of the surface 92 of the seat 87. In another embodiment, the rotatable and/or slidable chair 115 of the apparatus 10, 300, enables a user to more easily, safely and comfortably gain access to the rotatable and/or slidable chair 115 to support himself (with or without assistance) in a shower or bath tub 109 by rotating about the slidable pivot connectors 18 in a direction of the bidirectional arrow 89.

In one embodiment, the rotatable and/or slidable chair 115 comprise: the foldable back support 80, the seat 87 and foldable arms 82. In one embodiment, a height of the back support 80 from a plane formed by the surface 92 of the seat 87 is between about 8 in. and about 12 in. In one embodiment, a depth of the seat 87 along the plane formed by surface 92 is between about 12 and about 15 in. In one embodiment, a height of the foldable arms 82 from the plane formed by surface 92 is between about 6 and about 8 in.

In one embodiment, the seat 14, 87 of the rotatable and/or slidable chair 22, 115 of the apparatus 10, 300, has a wider front edge 48 than an edge 8 adjacent to the back 16, 80 of the rotatable and/or slidable chair 22, 115, and a flared front edge 3, extending the front edge 48 between about 15 inches and about 25 inches. In this embodiment, flared front edge 3 aids the user in initially sitting on the seat 87 by enlarging the area of the seat 87.

Figure 4:
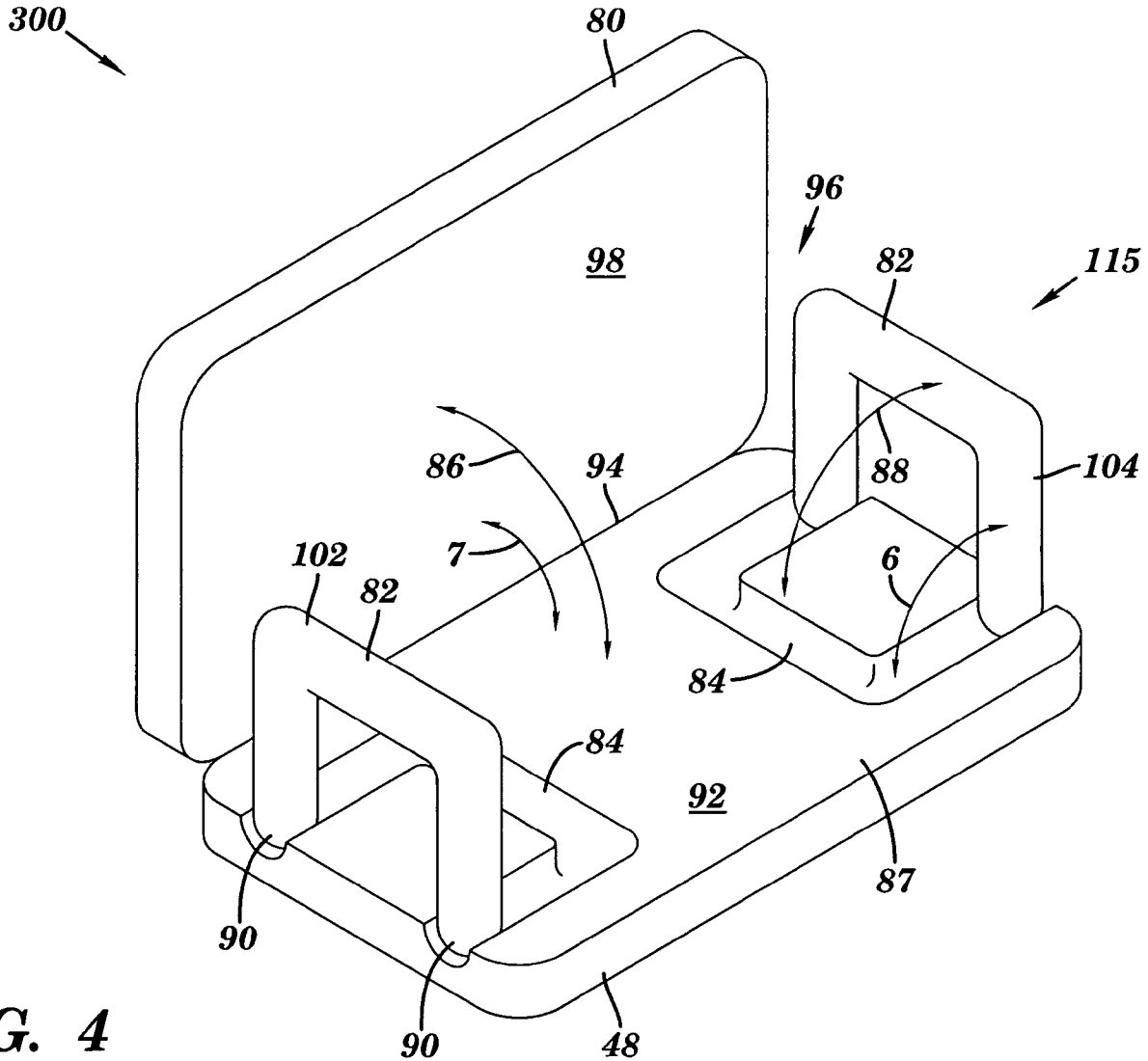
FIG. 4 depicts an elevation view of a rotatable and/or slidable chair, according to embodiments of the present invention.

FIG. 4 depicts an elevation view of an embodiment of the foldable chair 96 of the rotatable and/or slidable chair 115 of the apparatus 10, 300, depicted in FIGS. 3A, 3B, and described in associated text herein, having enhanced portability which enables a user to more easily, safely and comfortably support himself (with or without assistance) in a shower or bath tub 109. The foldable chair 96 of the rotatable and/or slidable chair 115 comprises a foldable back support 80, a seat 87, and foldable arms 82.

The foldable back support 80 may be operably coupled to the seat 87 so that the back support 80 may be moved in either direction of the bidirectional arrow 86. When opening the foldable back support 80, a first surface 98 of the foldable back support 80 is moved away from the first surface 92 of the seat 87. When in the open position, a person's back may be comfortably supported by forming an angle 7 between the first surface 98 of the foldable back support and the first surface 92 of the seat 87 from about 90° to about 180°, the angle 7 being formed at 94 where the first surface 98 of the foldable back support 87 joins the first surface 92 of the seat 87.

When in a closed position, the first surface 104 of the foldable arms 82 and the first surface 98 of the foldable back support 80 are moved toward the recesses 84 and the first surface 92 of the seat 87, respectively. When in the closed position, an angle 7 between the first surface 98 of the foldable back support and the first surface 92 of the seat 87 may be from about 0° to about 90°, the angle 7 being formed at 94 where the first surface 98 of the foldable back support 87 joins the first surface 92 of the seat 87.

Closing the foldable arms 82 and the foldable back 80 enables more easy and convenient transportation of the rotatable and/or slidable chair 115 because the chair 96 occupies less volume in the closed position and therefore doesn't require as wide a path during transportation or storage. When in the closed position, the angle 7 may be 0° and an outer surface 102 of the foldable arms 82 may be flush with the first surface 92 of the seat 87 and the first surface 98 of the back support 80 may be flush with a first surface 92 of the seat 87. Hereinafter, "being flush with" is defined as the first surface 92 of the seat 87 being adjacent to the first surface 98 of the back support 80 or the outer surface 102 of the foldable arms 82 being coplanar with the first surface 92 of the seat 87.

The foldable back support 80 may be opened or closed by pivoting in a direction of the arrow 86 on any appropriate joining device 94 such as, for example, a hinge or a strip of rubber or plastic. The hinge may be made of plastic, rubber, or metal, such as brass, stainless steel, tin, copper, or alloys of steel, tin, chromium, nickel, or copper. The plastic may be flexible plastic, curable silicone elastomer, organic elastomer, such as polyester or polyurethane, viton, sanoprene, or Ethylene-Propylene-Diene Monomer (EPDM).

In the folded embodiment, the rotatable and/or slidable chair 115 of the apparatus 10, 300 has enhanced portability because the chair 115 becomes more compact when the back support 80 pivots in the direction of the arrow 86 so that it is flush with the first surface 92 of the seat 87. The folding back or folding forward aids in making the seat more portable by allowing a reduction in the overall height when folded.

In one embodiment, the rotatable and/or slidable chair 115 of the apparatus 10, 300 enables a user to more easily, safely and comfortably support himself (with or without assistance) in a shower or bath tub 109 because the joining device 94 may pivot and be lockable in place or fixed in orientation to form a fixed angle 7 between about 90° and about 180° with respect to the first surface 98 of the back support 80 and the first surface 92 of the seat 87. Solid Brass Butler lockable hinges that will lock in place at 90° and 180° are available from Van Dyke's Restorers, PO BOX 278, 39771 S.D. HWY. 34, WOONSOCKET, SD 57385, PHONE: (605) 796-4425.

The foldable arms 82 may be operably coupled to the seat 87 and fold or pivot into recessed grooves 84 by rotating in a direction of the arrow 88 so that an inner surface 104 of the foldable arms 82 may be coplanar with the first surface 92 of the seat 87, or an outer surface 102 of the foldable arms 82 may be flush with the first surface 92 of the seat 87, or the foldable arms 82 may be in any position therebetween with respect to the first surface 92 of the seat 87. Hereinafter, "being flush with" is defined as the first surface 92 of the seat 87 being adjacent to the first surface 98 of the back support 80 or being coplanar with an outer surface 102 of the foldable arms 82. The foldable arms 82 may function as recessed folding handles that enable the seat 87 to be more portable by allowing recessed storage of the foldable arms 82 without sacrificing the stability benefit they provide when the user uses the foldable arms 82 as handles to support himself or herself, for example, when initially sitting down on the seat 87 or moving on the seat 87 to wash.

The inner surface 104 of foldable arms 82 may be coplanar with the first surface 92 of the seat 87, or the outer surface 102 may be flush with the first surface 92 of the seat 87 or in any position therebetween by pivoting in a direction of the arrow 88 on any appropriate joining device 90 such as, for example, a hinge or a strip of rubber or plastic. The hinge may be made of plastic, rubber, or metal, such as brass, stainless steel, tin, copper, or alloys of steel, tin, chromium, nickel, or copper. The plastic may be flexible plastic, curable silicone elastomer, organic elastomer, such as polyester or polyurethane, viton, sanoprene, or Ethylene-Propylene-Diene Monomer (EPDM). In a folded embodiment, the rotatable and/or slidable chair 115 of the apparatus 10, 300, has enhanced portability because the rotatable and/or slidable chair 115 becomes more compact when the foldable arms 82 pivot in the direction of the arrow 88 so that the outer surface 102 of the foldable arms 82 become flush with the first surface 92 of the seat 87. In one embodiment, the rotatable and/or slidable chair 115 of the apparatus 10, 300, enables a user to more easily, safely and comfortably support himself (with or without assistance) in a shower or bath tub 18 because the joining device 90 may pivot and be lockable in place or fixed in orientation to form a fixed angle 6 between about 10° and about 260° with respect to the inner surface 104 of the foldable arms 82 and the first surface 92 of the seat 87. Solid Brass Butler lockable hinges that will lock in place at 90° and 180° are available from Van Dyke's Restorers, PO BOX 278, 39771 S.D. HWY. 34, WOONSOCKET, SD 57385, PHONE: (605) 796-4425.

Figure 5:
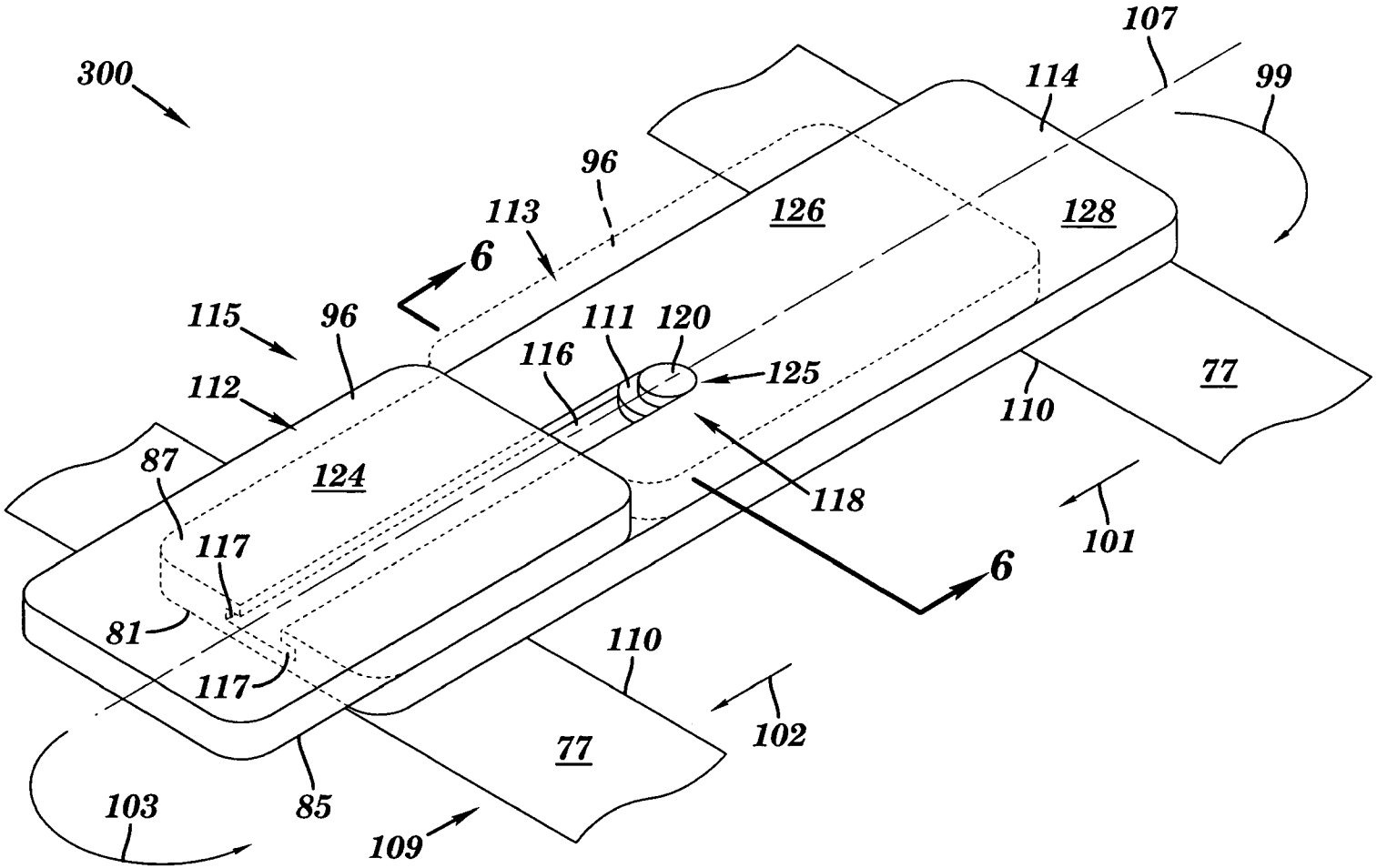
FIG. 5 depicts an elevation view of an apparatus having enhanced portability, according to embodiments of the present invention.

FIG. 5 depicts an elevation view of the rotatable and/or slidable chair 115 of the apparatus 10, 300, depicted in FIG. 3A, having enhanced portability, which enables a user to more easily, safely and comfortably support himself (with or without assistance) in a shower or bath tub 109. The apparatus 10, 300, comprises: a rotatable and/or slidable chair 115, and a shower or bath tub 109. The rotatable and/or slidable chair 115 comprises an elongated base 114 and a foldable chair 96. The elongated base 114 lies between the seat 87 of the foldable chair 96 of the rotatable and/or slidable chair 115 and the surface 77 of the walls 110 of the shower or bath tub 109.

The rotatable and/or slidable chair 115 may be operably coupled to a slidable pivot connector 118. The slidable pivot connector 118 may be a pin or axle 120, having a concentric collar 111. The slidable pivot connector 118 for moving the rotatable and/or slidable chair 115 along a slot 116 cut into the seat 87 of the foldable chair 96 along the longitudinal axis 107 of the rotatable and/or slidable chair 115. The slidable pivot connector 118 and a pin or axle 120 enables the rotatable and/or slidable chair 115 to rotate in the direction of the arrows 99 or 103.

The seat 87 of the rotatable and/or slidable chair 115 has a second position 112 and surface 124 or a first position 113 and surface 126, wherein the seat 87 in second position 112 has moved from the first position 113 to the second position 112. The surfaces 124, 126 may be in a plane that is parallel to a surface 128 of the elongated base 114. A grooved channel 116, having grooves 117, is shown cut into the bottom surface 85 of the seat 87 of the foldable chair 96 in position 112. The seat 87 of the rotatable and/or slidable chair 115 is operably coupled to the elongated base 114 using slidable pivot connector 118 by mechanically and physically attaching the slidable pivot connector 118 to the surface 128 of the elongated base 114. The slidable pivot connector 118 comprises a pin or axle 120 having a longitudinal axis 125 and a concentric collar 111 that may slide along grooves 117 in the grooved channel 116.

In an embodiment of the apparatus 10, 300, the seat 87 of the rotatable and/or slidable chair 115 may be de-coupled from the slidable pivot connector 108, providing access so that the swivel 118 and the pin or axle 120 and the slot 116 may be lubricated, cleaned or repaired.

In an embodiment of the apparatus 10, 300, the seat 87 may be de-coupled from the slidable pivot connector 118 for easy disassembly of the rotatable and/or slidable chair 115.

When seat 87 of the rotatable and/or slidable chair 115 is in position 113, an embodiment of the apparatus 10, 300 having enhanced portability which enables a user to more easily, safely and comfortably support himself (with or without assistance) in a shower or bath tub 109, the seat 87 of the rotatable and/or slidable chair 115 is shown coupled to the slidable pivot connector 118, enabling the seat 87 to slide in a direction of the arrows 101, 102, in the slot 116 along the longitudinal axis 107 of the elongated base 114. Coupling the seat 87 of the rotatable and/or slidable chair 115 to the slidable pivot connector 118 also enables the seat 87 to rotate about the pin or axle 120 on its longitudinal axis 125 that is orthogonal to the longitudinal axis 107 of the elongated base 114 in a direction of the arrows 103, 99.

FIG. 6 depicts a horizontal cross-sectional view of the apparatus 10, 300, having enhanced portability, which enables a user to more easily, safely and comfortably support himself (with or without assistance) in a shower or bath tub 109, taken along line 6-6 of FIG. 5. The apparatus 10, 300, comprises: a rotatable and/or slidable chair 115, and a shower or bath tub 109. The rotatable and/or slidable chair 115 comprises an elongated base 114 and a foldable chair 96. Referring to FIG. 5, the elongated base 114 lies between the seat 87 of the foldable chair 96 of the rotatable and/or slidable chair 115 and the surface 77 of the walls 110 of the shower or bath tub 109.

The elongated base 114 has an upper surface 83 and a parallel oppositely disposed lower surface 79. Referring to FIG. 5, the bottom surface 85 of the seat 87 of the rotatable and/or slidable chair 115 and the upper surface 83 of the elongated base 114 form an interface 81 that lies in a longitudinal plane defined by the points A, B, C, and D that lie in the surface 83 of the elongated base 114. Therefore, the upper surface 83 of the elongated base 114 supports the seat 87 because the lower surface 85 of the seat 87 lies on the upper surface 83 of the elongated base 114. The rotatable and/or slidable chair 115 may be supported by the walls 105 of the bathtub or shower 109 because the lower surface 79 of the elongated base 114 lies on the surface 77 of the walls 105 of the shower or bath tub 109.

A grooved channel 116, having grooves 117 has been cut into a bottom surface 85 of the seat 87 of the rotatable and/or slidable chair 115. A slidable pivot connector 118 running along the longitudinal axis 107 of the grooved channel 116, may operably couple the elongated base 114 and the seat 87 of the foldable chair 96. The slidable pivot connector 118 may be a pin or axle 120 having a concentric collar 111. Hereinafter, "operably coupling" or "operably coupled" is defined as linking or mechanically and physically attaching a first supporting structure, such as the rotatable and/or slidable chair 115 to a second supporting structure, such as the elongated base 114, so that the first supporting structure may freely rotate in a direction of the arrow 89 about a vertical axis running perpendicularly to a longitudinal plane of the second supporting structure and/or slide in a direction of the bidirectional arrow 110 along the longitudinal plane of the second supporting structure.

The slidable pivot connector 118 comprises a pin or axle 120 having a concentric collar 111, the pin or axle 120 having a longitudinal axis that is orthogonal to the longitudinal axis 107 of the rotatable and/or slidable chair 115. Referring to FIG. 6, the pin or axle 120 extends from a well 9 within the elongated base 114 into the grooved channel 116 that lies within the seat 87 of the rotatable and/or slidable chair 115 and runs along the longitudinal axis 107. The slidable pivot connector 118 may be a pin or axle 120 having a concentric collar 111. When the slidable pivot connector 118 is a pin or axle 120 having the concentric collar 111, the pin or axle 120 runs along the slot 116 and the concentric collar 111 runs along the grooves 117 both of which run along the longitudinal axis 107, operably coupling the rotatable and/or slidable chair 115 to the elongated base 114. Hereinafter, "operably coupling" or "operably coupled" is defined as linking or mechanically and physically attaching a first supporting structure, such as the rotatable and/or slidable chair 115 to a second supporting structure, such as the elongated base 114, so that the first supporting structure may freely rotate in a direction of the arrow 89 about a vertical axis running perpendicularly to a longitudinal plane of the second supporting structure and/or slide in a direction of the bidirectional arrow 110 along the longitudinal plane of the second supporting structure. The slidable pivot connector 118 may be a type of connector used in a lazy susan for operably coupling a rotatable tray and a supporting structure. Hereinafter, a "lazy susan" is defined as a rotatable tray used for serving food, condiments, or relishes. The tray may rotate on a pin or axle 120. The slidable pivot connector 118 may be a ball and socket connector, in which one end of the ball and socket may be inserted into the surface 83 of the elongated base 114, and another end of the ball and socket may be attached to the seat 87 of the foldable chair 96. Alternatively, the slidable pivot connector 118 may be a swivel and pin or axle connector, having a pin or axle 120 inserted into the surface 83 of the elongated base 114, or into the bottom surface 85 of the seat 87, so that the ball and socket connector or the swivel and pin or axle connector operably couples the first and second supporting structures, such as the rotatable and/or slidable chair 115 and the elongated base 114.

The rotatable and/or slidable chair 115 may be operably coupled to a slidable pivot connector 118 and a pin or axle 120 for moving the rotatable and/or slidable chair 115 along a slot 116 cut into a bottom surface 85 the seat 87 of the foldable chair 96 along the longitudinal axis 107 of the rotatable and/or slidable chair 115. The slidable pivot connector 118 and a pin or axle 120 enables the rotatable and/or slidable chair 115 to rotate in the direction of the arrows 99 or 103.

Figure 7:
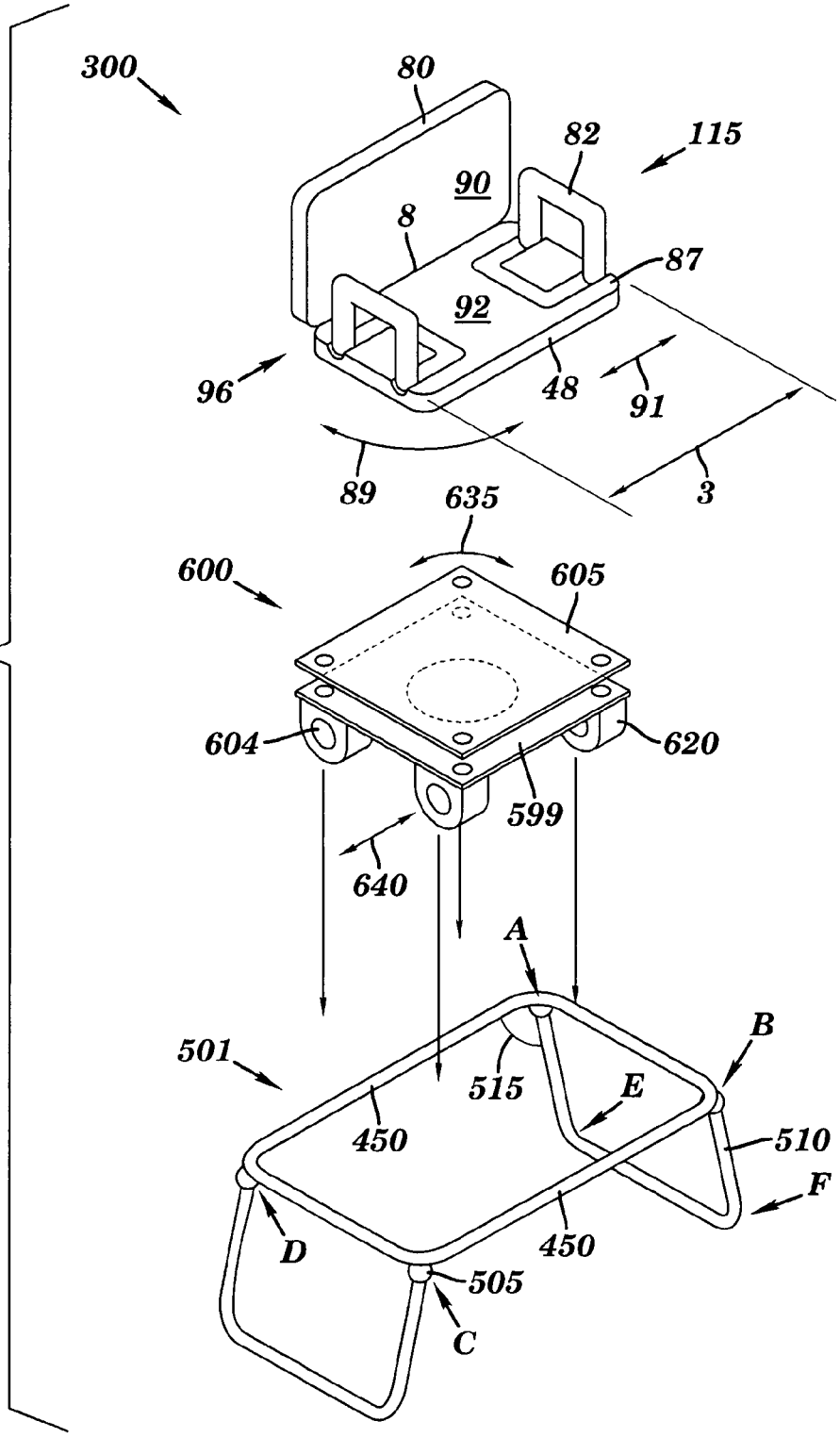
FIG. 7 depicts an elevation view of an apparatus having enhanced portability, according to embodiments of the present invention.

FIG. 7 depicts an elevation view of the rotatable and/or slidable chair 115 depicted in FIGS. 3-6, further comprising a slidable pivot connector 600, e.g. a carousel connector, and a frame 501.

In one embodiment, the seat 14, 87 of the rotatable and/or slidable chair 22, 115 of the apparatus 10, 300, 500 has a wider front edge 48 than an edge 8 adjacent to the back 16, 80 of the rotatable and/or slidable chair 22, 115, and a flared front edge 3, extending the front edge 48 between about 15 inches and about 25 inches. In this embodiment, flared front edge 3 aids the user in initially sitting on the seat 87 by enlarging the area of the seat 87.

The slidable pivot connector 600, e.g. a carousel connector, is between the rotatable and/or slidable chair 115 and the frame 501. The slidable pivot connector 600, e.g. a carousel connector, comprises: a mount 605, and a base 599 supported by blocks 620, wherein the blocks 620 may be non-metallic pillow blocks made of nylon, rubber, or flexible plastic available from Metalized Carbon Company, Ossining, N.Y. Each of the blocks 620 have a central lumen 604, wherein the outer diameter of the frame tubes 450 of the frame 501 is less than or equal to the diameter of the central lumen 604 of the blocks 620, so that the blocks 620 slide along the frame tubes 450 when the frame tubes 450 are inserted within the lumen 604 of the blocks 620 therein.

The rotatable and/or slidable chair 115 may rotate in a direction of the bidirectional arrow 635 because the mount 605 of the slidable pivot connector 600, e.g. a carousel connector, is operably coupled to the rotatable and/or slidable chair 115 and because the mount 605 is rotatable in the direction of the bidirectional arrow 635. The rotatable and/or slidable chair 115 is slidable in the direction of the bidirectional arrow 640 because the mount 605 of the slidable pivot connector 600, e.g. a carousel connector, is operably coupled to the rotatable and/or slidable chair 115 and because the mount 605 is operably coupled to the base 599 and the blocks 620 of the base 599 slide on the rails 450 of the frame 501.

Figure 8:
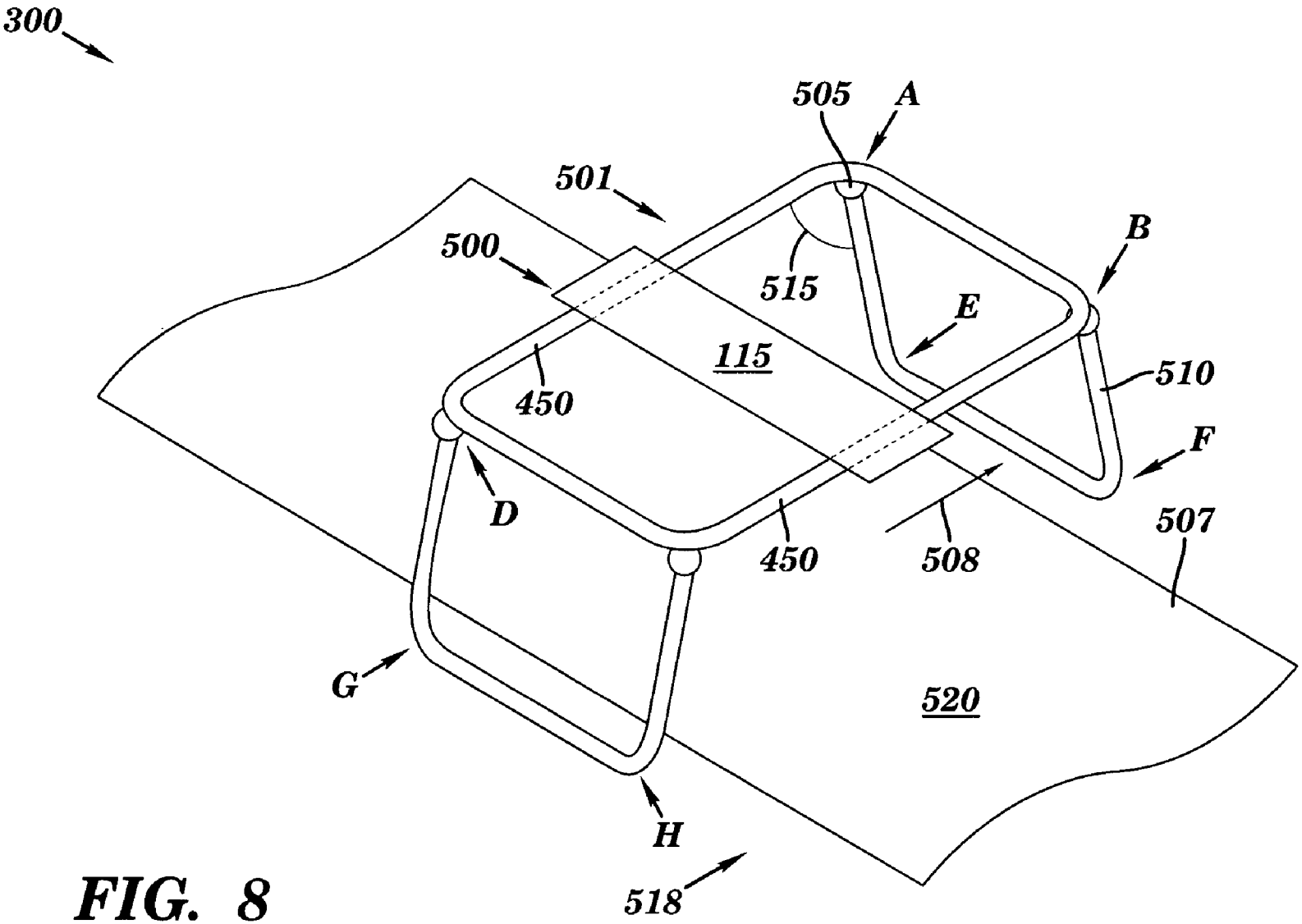
FIG. 8 depicts an isometric view of a frame, according to embodiments of the present invention.

The frame 501 has legs 510 that either sit directly on the bottom inside surface 520 of a shower or bath tub 518 or that straddle walls 507 of a shower or bath tub 518 and supports the rotatable and/or slidable chair 115, depicted in FIG. 8, and described in associated text, herein. The legs 510 are operably coupled to the frame 501, forming angles DAE, CBF, BCH, GDA, 515, at the joints between the legs 510 and the plane ABCD, wherein the angle 515 may be between about 0° and 180°. In one embodiment, the angle, at the joints between the legs 510 and the plane ABCD, is 105°.

In one embodiment, the frame is 36 in. long×20 in. high×15 in. deep. In one embodiment, the rotatable and/or slidable chair 115 may be fixed-in-place. In another embodiment, the rotatable and/or slidable chair 115 may be allowed to slide relative to the frame 501 in a direction of the arrow 508.

In one embodiment, the apparatus 500, comprises a slidable and/or rotatable chair 115, a slidable pivot connector 600, e.g. a carousel connector, and a frame 501. The frame 501, having legs 510, wherein the legs 510 collapse under the frame 501, so that the apparatus 500 has a smaller three dimensional volume, based on the length, depth and height of the apparatus 500. In one embodiment, the three dimensional volume is 1,080 cubic inches when the frame 501 is 36 in. long×20 in. high×15 in. deep, when the legs 510 are extended under the frame 501 to support it. The three dimensional volume is 720 cubic inches when the frame 501 is 36 in. long×20 in. high×1 in. deep when the legs 510 are collapsed under the frame 501 for easier and more comfortable and safe transporting or carrying the apparatus 500. The three dimensional volume may be reduced by 720 cubic inches/1,020 cubic inches, or about 31% by folding the legs 510 under the frame 501.

The slidable and/or rotatable chair 115 may, in some embodiments, have a foldable back support and foldable arms attached to it for additional support of the user.

FIG. 8 depicts an isometric view of the frame 501 of the apparatus 500, as depicted in FIG. 7 and described herein, further comprising the legs 510 of the frame straddling a shower or bathtub 518, the apparatus 500 having enhanced portability, which enables a user to more easily, safely and comfortably support himself (with or without assistance) in a shower or bath tub 518. In one embodiment, the shower seat or bench 500 comprises; 1) a frame 501 and 2) the seat 115, as depicted in FIGS. 3-7 and described herein. The frame 501 has legs 510 that either rest directly on the bottom inside surface 520 of the shower or bath tub 518 or that straddle walls 507 of the shower or bath tub 518 and supports the seat 115. The legs 510 are operably coupled to the frame 501, forming an angle 515, wherein the angle, 515, may be between about 0° and 180°. Legs 510 aid in making the seat more portable by allowing a reduction in the overall height of the shower seat or bench 500 of the apparatus 10, 300, 500 when collapsed.

In one embodiment, the frame is 36 in. long×20 in. high×15 in. deep. In one embodiment, the rotatable and/or slidable chair 115 may be fixed-in-place. In another embodiment, the fixed-in-place. In another embodiment, the rotatable and/or slidable chair 115 may be allowed to slide relative to the frame 501 in a direction of the arrow 508. The seat may, in some embodiments, have a foldable back support and foldable arms for additional support of the user.

Figure 9:
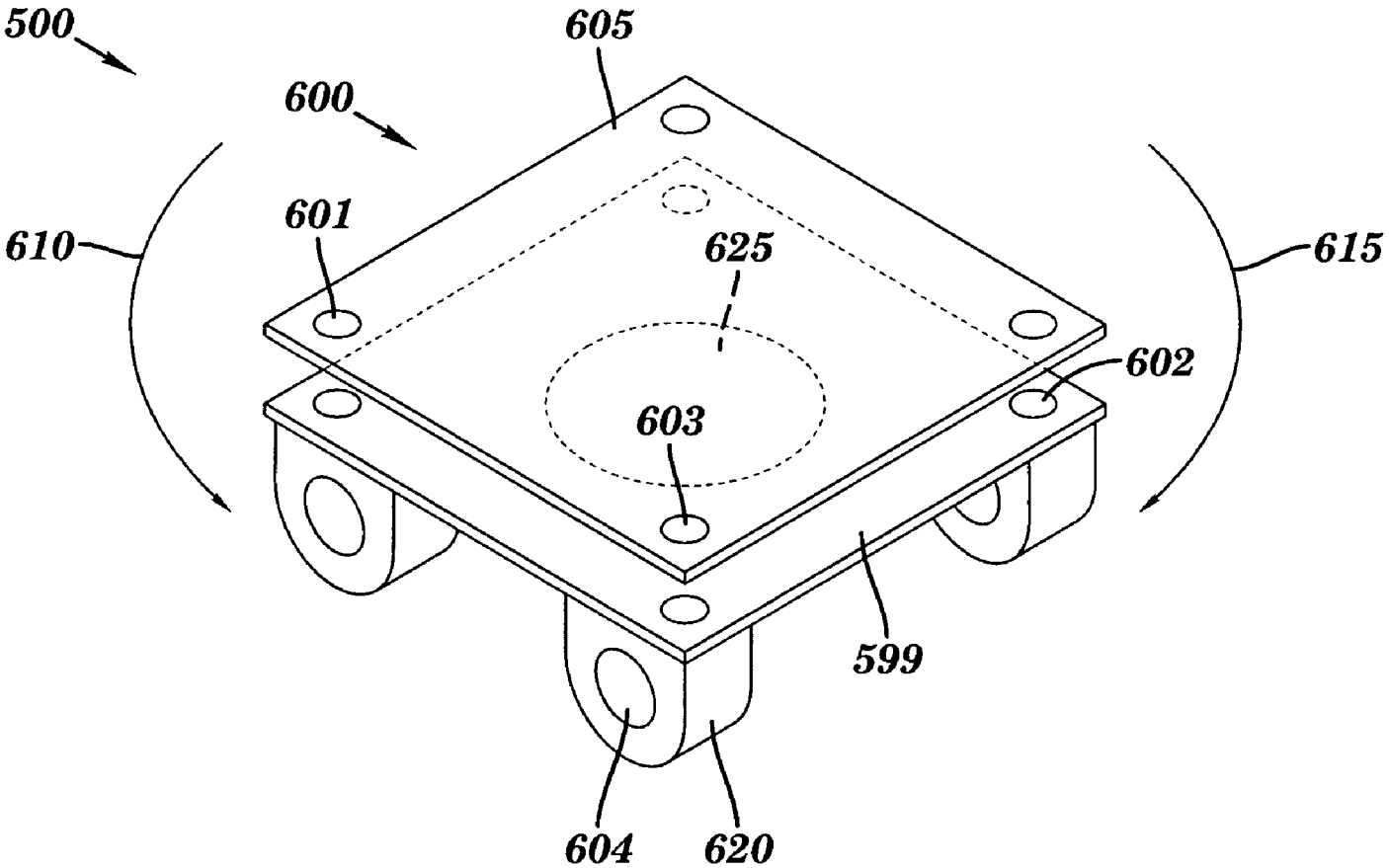
FIG. 9 depicts an isometric view of a slidable pivot connector, according to embodiments of the present invention.

FIG. 9 depicts an isometric view of a slidable pivot connector 600, e.g. a carousel connector, of the apparatus 300, depicted in FIGS. 7-8 and described in associated text herein. The slidable pivot connector 600, e.g. a carousel connector, comprises: a mount 605 operably coupled to a carriage 599. The carriage 599 comprises a bearing 625 that rotates on an axis of rotation 603 in a direction of the arrows 615, 610. The slidable pivot connector 600, e.g. a carousel connector, comprises a mount 605, and a base 599 supported by blocks 620, wherein the blocks 620 may be non-metallic pillow blocks made of nylon, rubber, or flexible plastic available from Metalized Carbon Company, Ossining, N.Y. Each of the blocks 620 have a central lumen 604, wherein the outer diameter of the frame tubes 450 of the frame 501 is less than or equal to the diameter of the central lumen 604 of the blocks 620, so that the blocks 620 slide along the frame tubes 450 when the frame tubes 450 are inserted within the lumen 604 of the blocks 620 therein.

In one embodiment, an apparatus 10, 300, 500, is provided, comprising: an elongated base 12, comprising a tapered yoke 24 operably coupled to a first end 56 of the elongated base 12 and a slidable pivot connector 191 operably coupled to a second end 54 of the elongated base 12; a rotatable and/or slidable chair 22 comprising a seat 14, a back 16 and a plurality of arms 20, wherein the plurality of arms 20 are operably coupled to only the seat 14 and do not come in contact with the back 16 of the rotatable and/or slidable chair 22 so that an outermost surface 33 of the arms 20 of the rotatable and/or slidable chair 22 form a coplanar surface with a first surface 31 of the seat 14 by folding into recesses 34 in the seat 14, and wherein the rotatable and/or slidable chair 22 is operably coupled to the same end 56 of the elongated base 12 as the tapered yolk 24.

In one embodiment, the back 16 of the rotatable and/or slidable chair 22 of the apparatus 10, 300, 500, is foldable.

In one embodiment, a joining device 15, 94 operably couples the back 16, 80 and the seat 14, 87 of the apparatus 10, 300, 500 so that the seat 14, 87 folds to meet a plane of the first surface 31, 92 of the seat 14, 87 of the rotatable and/or slidable chair 22, 115.

In one embodiment, an angle formed between the back 16, 80 and the first surface 31, 92 is 100°.

In one embodiment, the angle formed between the back 16, 80 and the first surface 31, 92 of the seat 14, 87 of the rotatable and/or slidable chair 22, 115 of the apparatus 10, 300, 500 is from about 100° and 170°.

In one embodiment, the slidable pivot connector 108 of the apparatus 10, 300, 500 is a ball in a socket.

In one embodiment, the rotatable and/or slidable chair 22, 115 of the apparatus 10, 300, 500 has a weight from about 6 lbs. to about 10 lbs.

In one embodiment, the rotatable and/or slidable chair 22, 115 of the apparatus 10, 300, 500 is made of hollow moldable plastics selected from the group consisting of polyvinylchloride (PVC), high or low density polypropylene, high or low density polyethylene, polystyrene, silicone rubber, silicone elastomer, organic elastomer, viton, sanoprene and ethylene propylene diene monomer EPDM.

In one embodiment, the apparatus 10, 500 comprises a slidable and/or rotatable chair 22, 115 operably coupled to an elongated base 12, 114 or a frame 501. The elongated base 12, 114 or the frame 501, having legs 52, 510, wherein the legs 52, 510 collapse into recesses 187 in the elongated base 12, 114 or under the frame 501, so that the apparatus 10, 500 has a smaller three dimensional volume, based on the length, depth and height of the apparatus 10, 500.

In one embodiment, the apparatus 10, 500 comprises a slidable and/or rotatable chair 22, 115 operably coupled to an elongated base 12, or a frame 501. The elongated base 12, or the frame 501, having legs 52, 510 operably coupled to a second surface 42 of the seat 14, or the frame 510, wherein the legs 52, 510 collapse into recesses 187 in the elongated base 12, or under the frame 501. The legs 52, 510 are operably coupled to only the seat 14, or the frame 501, so that an outermost surface of the legs 52, 510 of the rotatable and/or slidable chair 22, 115 form a coplanar surface with the second surface 41 of the seat 14, or the frame 501, by folding into recesses 187 in the seat 14 or under the frame 501.

In one embodiment, the apparatus 10, 500 comprises a slidable and/or rotatable chair 22, 115 operably coupled to an elongated base 12, 114 or a frame 501. The slidable and/or rotatable chair 22, 115 comprising a seat 14, 87 and arms 20, 82, the seat 14, 87 having recesses 84 and arms 20, 82 therein.

In one embodiment, the tapered yolk 24 of the apparatus 10 is rotatable from about 0° to about 360°.

In one embodiment, the slidable pivot connector 47, 108, 600 between the slidable and/or rotatable chair 22, 115 and the elongated base 12, 114, or the frame 501 of the apparatus 10, 300, 500 is a lazy susan or a pin-in-slot.

In one embodiment, the seat of the rotatable and/or slidable chair 22, 115 of the apparatus 10, 300, 500 has a wider front edge than an edge adjacent to the back 16, 80 of the rotatable and/or slidable chair 22, 115, and a flared front edge 3, extending the front edge between about 15 inches and about 25 inches.

In one embodiment, an apparatus 10, 300 and 500 is provided, comprising: a rotatable and/or slidable chair 22, 115 comprising a seat 87, a back 80 and a plurality of arms 82, either an elongated base 12, 114 and a slidable pivot connector 47, 108, 600, therein; or a frame 501 and a slidable pivot connector 47, 108, 600, e.g. a carousel connector, supported by the frame 501; wherein the elongated base 114 and the slidable pivot connector 47, 108, 600, therein, or the slidable pivot connector 47, 108, 600, e.g. a carousel connector, are operably coupled to the rotatable and/or slidable chair 115.

In one embodiment, the slidable pivot means is a ball and socket connector.

In one embodiment, the slidable pivot means is a lazy susan or a pin-in-slot connector.

In one embodiment, an apparatus 10 is provided, comprising: an elongated base 12, having a tapered yoke 24 operably coupled to a first end 56 of the elongated base 12; a rotatable and/or slidable chair 22, comprising a seat 14, a back 16, and a plurality of arms 20. The arms 20 are operably coupled to only the seat 14 and do not come in contact with the back 16 of the rotatable and/or slidable chair 22 so that an outermost surface 33 of the arms 20 of the rotatable and/or slidable chair 22 form a coplanar surface with a first surface 31 of the seat 14 by folding into recesses 34 in the seat 14, and wherein the rotatable and/or slidable chair 22 is operably coupled to the same end of the elongated base 12 as the tapered yolk 24 by a slidable pivot means 191 for rotating the rotatable and/or slidable chair 22 from about 0° to about 360°.

In one embodiment, the slidable pivot means 191 is a ball and socket connector.

In one embodiment, the slidable pivot means 191 is a pin-in-slot connector.

Figure 10:
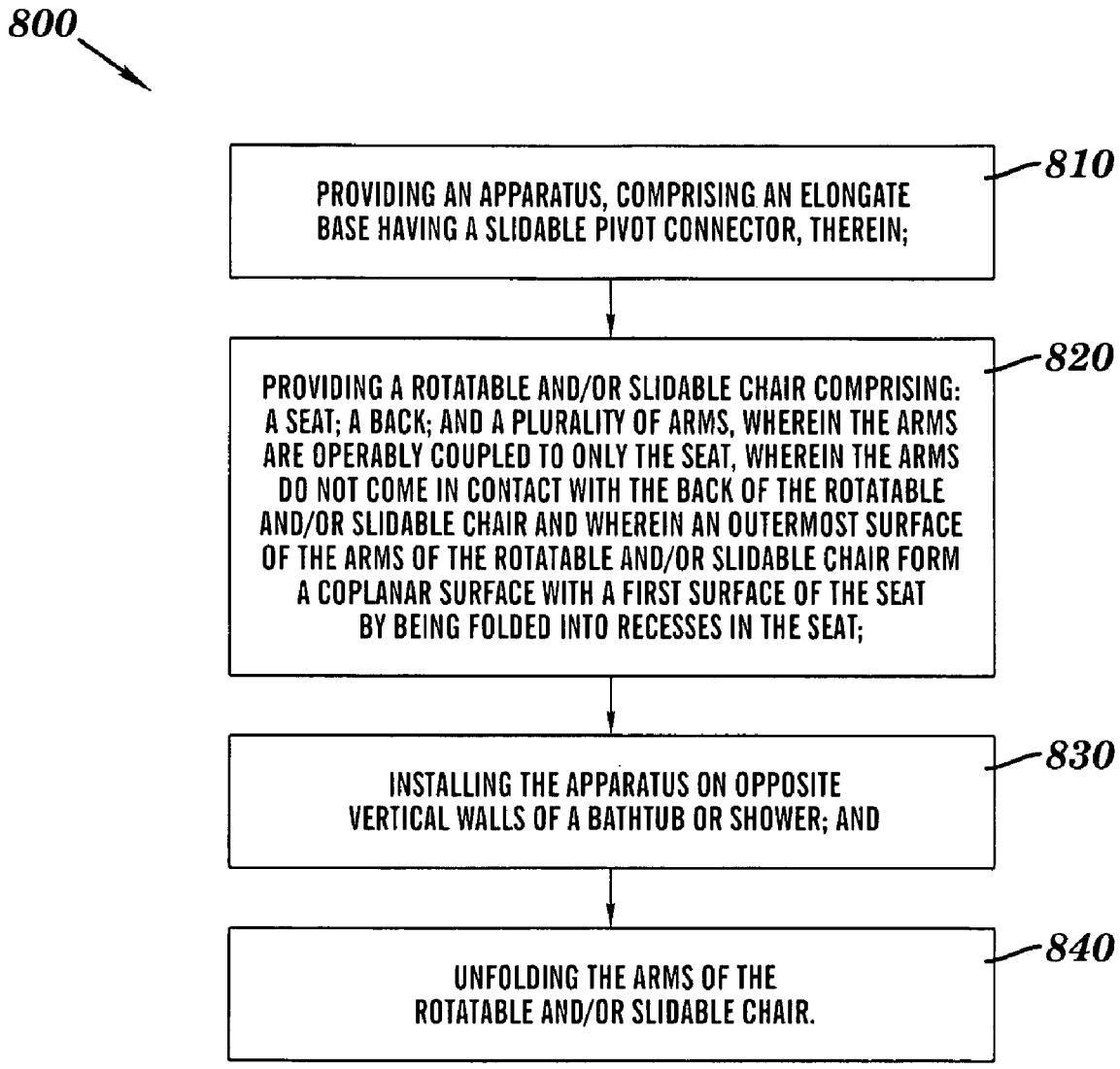
FIG. 10 is a flow sheet of a method 800 for supporting a person in a bath tub or a shower, according to embodiments of the present invention.

FIG. 10 is a flow sheet of a method 800 for supporting a person in a bath tub or a shower, comprises a step 810, providing an apparatus 10, 300, 500 comprising: an elongated base 12, 114 having a slidable pivot connector 191, 108 therein; a step 820, providing a rotatable and/or slidable chair 22, 115, comprising a seat 14, 87, a back 16, 80 and a plurality of arms 20, 82. The arms 20, 82 are operably coupled to only the seat 14, 87. The arms 20, 82 do not come in contact with the back 16, 80 of the rotatable and/or slidable chair 22, 115. An outermost surface 33 of the arms 20, 82 of the rotatable and/or slidable chair 22, 115 form a coplanar surface with a first surface 31, 92 of the seat 14, 87 by being folded into recesses 34, 84 in the seat 14, 87; a step 820, installing the apparatus 10, 300, 500 on opposite vertical walls 38, 40, 110, of a bathtub or shower 18, 109; a step 830, unfolding the arms 20, 82 of the rotatable and/or slidable chair 22, 115.

In one embodiment of the method 800, the slidable pivot connector 191, 108 rotates the rotatable and/or slidable chair from about 0° to about 360°.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore, it is intended that the following claims cover all such modifications and changes as fall within the true spirit and scope of the invention.

We claim:

1. A method for supporting a person in a bath tub or a shower stall, comprising:

providing an apparatus, comprising an elongated base having a slidable pivot connector, therein;

providing a rotatable and/or slidable chair comprising:

a seat;

a back; and a plurality of arms, wherein the arms are operably coupled to only the seat, wherein the arms do not come in contact with the back of the rotatable and/or slidable chair and wherein an outermost surface of the arms of the rotatable and/or slidable chair form a coplanar surface with a first surface of the seat by being folded into recesses in the seat;

installing the apparatus on opposite vertical walls of a bathtub or shower; and unfolding the arms of the rotatable and/or slidable chair.

2. An apparatus, comprising:

an elongated base having a tapered yoke operably coupled to a first end of the elongated base;

a rotatable and/or slidable chair, comprising:

a seat;

a back; and a plurality of arms, wherein the arms are operably coupled to only the seat and do not come in contact with the back of the rotatable and/or slidable chair so that an outermost surface of the arms of the rotatable and/or slidable chair form a coplanar surface with a first surface of the seat by folding into recesses in the seat, and wherein the rotatable and/or slidable chair is operably coupled to the same end of the elongated base as the tapered yolk by a slidable pivot connector for effecting the rotation of the rotatable and/or slidable chair from about 0° to about 360°.

3. The apparatus of claim 2, wherein the back of the rotatable and/or slidable chair is foldable.

4. The apparatus of claim 2, wherein a joining device operably couples the back and the seat of the apparatus, so that the seat folds to meet a plane of the first surface of the rotatable and/or slidable chair.

5. The apparatus of claim 3, wherein an angle formed between the back and the first surface is from about 80° and 170°.

6. The apparatus of claim 5, wherein the angle formed between the back and the first surface is about 100°.

7. The apparatus of claim 2, wherein the rotatable and/or slidable chair has a weight from about 6 lbs. to about 10 lbs.

8. The apparatus of claim 7, wherein the rotatable and/or slidable chair is made of hollow moldable plastics selected from the group consisting of polyvinylchloride (PVC), high or low density polypropylene, high or low density polyethylene, polystyrene, silicone rubber, silicone elastomer, organic elastomer, viton, sanoprene and ethylene propylene diene monomer EPDM.

9. The apparatus of claim 2, comprising:

foldable legs operably coupled to a second surface of the seat, wherein the foldable legs are operably coupled to only the seat, so that an outermost surface of the legs of the rotatable and/or slidable chair form a coplanar surface with the second surface of the seat by folding into recesses in the seat.

10. The apparatus of claim 9, wherein the second surface of the rotatable and/or slidable chair and outermost surface of the foldable legs are coplanar.

11. The apparatus of claim 2, wherein the tapered yolk is rotatable from about 0° to about 360°.

12. The apparatus of claim 2, comprising a shower or bath tub, wherein the stabilizer on the second end of the elongated base may be a non-slip stabilizer operably coupled to a surface of the second end of the elongated base, so that slippage of the elongated base and the whole apparatus in a direction orthogonal to the longitudinal axis of the elongated base is substantially prevented when the non-slip stabilizer lies on a supporting surface of a wall of the shower or bath tub, thereby essentially completely stabilizing the second end of the elongated base and the rotatable and/or slidable chair, thereon.

13. The apparatus of claim 2, wherein the slidable pivot connector is a pin-in-slot connector.

14. A kit, comprising:

a bathtub or shower;

an elongated base having a tapered yoke operably coupled to a first end of the elongated base;

a rotatable and/or slidable chair, comprising:

a seat;

a back; and a plurality of arms, wherein the arms are operably coupled to only the seat and do not come in contact with the back of the rotatable and/or slidable chair so that an outermost surface of the arms of the rotatable and/or slidable chair form a coplanar surface with a first surface of the seat by folding into recesses in the seat, and wherein the rotatable and/or slidable chair is operably coupled to the same end of the elongated base as the tapered yolk by a slidable pivot connector for rotating the rotatable and/or slidable chair from about 0° to about 360°.

15. The apparatus of claim 14, wherein the back of the rotatable and/or slidable chair is foldable.

16. The apparatus of claim 14, wherein a joining device operably couples the back and the seat of the apparatus, so that the seat folds to meet a plane of the first surface of the rotatable and/or slidable chair.

17. The apparatus of claim 14, wherein an angle formed between the back and the first surface is from about 80° and 170°.

18. The apparatus of claim 17, wherein the angle formed between the back and the first surface is about 100°.

19. The apparatus of claim 14, wherein the rotatable and/or slidable chair has a weight from about 6 lbs. to about 10 lbs.

20. The apparatus of claim 19, wherein the rotatable and/or slidable chair is made of hollow moldable plastics selected from the group consisting of polyvinylchloride (PVC), high or low density polypropylene, high or low density polyethylene, polystyrene, silicone rubber, silicone elastomer, organic elastomer, viton, sanoprene and ethylene propylene diene monomer EPDM.

21. The apparatus of claim 14, comprising:

foldable legs operably coupled to a second surface of the seat, wherein the foldable legs are operably coupled to only the seat, so that an outermost surface of the legs of the rotatable and/or slidable chair form a coplanar surface with the second surface of the seat by folding into recesses in the seat.

22. The apparatus of claim 21, wherein the second surface of the rotatable and/or slidable chair and outermost surface of the foldable legs are coplanar.

23. The apparatus of claim 14, wherein the tapered yolk is rotatable from about 0° to about 360°.

24. The apparatus of claim 14, comprising a shower or bath tub, wherein the stabilizer on the second end of the elongated base may be a non-slip stabilizer operably coupled to a surface of the second end of the elongated base, so that slippage of the elongated base and the whole apparatus in a direction orthogonal to the longitudinal axis of the elongated base is substantially prevented when the non-slip stabilizer lies on a supporting surface of a wall of the shower or bath tub, thereby essentially completely stabilizing the second end of the elongated base and the rotatable and/or slidable chair, thereon.

25. The apparatus of claim 14, wherein the slidable pivot connector is a pin-in-slot connector.

* * * * *